US005933441A

United States Patent [19]

Chen

[11] Patent Number: 5,933,441

[45] Date of Patent: Aug. 3, 1999

[54] CIRCUIT FOR PROTECTING A LASER INDICATOR

[76] Inventor: Hung-Ping Chen, No. 35, Chun An St. Shu Lin Chen, Taipei Hsien, Taiwan

[21] Appl. No.: 08/965,204

[22] Filed: Nov. 6, 1997

[51] Int. Cl.[6] ..... G05F 3/22

[52] U.S. Cl. ..... 372/38; 327/514; 327/542; 330/288

[58] Field of Search ..... 372/38; 330/288; 327/514, 542, 545, 546

[56] References Cited

U.S. PATENT DOCUMENTS

| | | | |
|---|---|---|---|
| 3,631,268 | 12/1971 | Matthews | 327/514 X |
| 4,109,217 | 8/1978 | Brackett et al. | 372/38 |
| 4,565,973 | 1/1986 | Nagano | 330/288 |
| 4,689,499 | 8/1987 | Yee | 327/514 X |
| 5,097,145 | 3/1992 | Hayashi | 327/514 X |
| 5,373,518 | 12/1994 | Uchiyama et al. | 372/38 |
| 5,514,989 | 5/1996 | Sato et al. | 327/514 X |
| 5,539,352 | 7/1996 | DuPuy | 327/514 |
| 5,554,954 | 9/1996 | Takahashi | 327/546 |

*Primary Examiner*—John D. Lee
*Attorney, Agent, or Firm*—Welsh & Katz, Ltd.

[57] ABSTRACT

A circuit for protecting a laser indicator is disclosed in which a current amplifying circuit composed of two transistors drives a laser light emitting diode (LED) to generate a laser light. A base of one of the two transistors connects with a protective resistor and a variable resistor. The variable resistor is used to control the magnitude of a base current of the transistor and the protective resistor is used to prevent an overrating current. A diode is further coupled to a positive power input terminal of the current amplifying circuit to prevent the circuit for protecting a laser indicator from being damaged due to being reversely connected the polarities of the power source. Through a design of such a circuit, a stable laser light-spot is achieved and the components in the circuit will not be damaged.

4 Claims, 2 Drawing Sheets

CIRCUIT FOR PROTECTING A LASER INDICATOR

BACKGROUND OF THE INVENTION

1. The Field of the Invention

The present invention relates to a circuit for protecting a laser indicator, more particularly, to a design of such a protective circuit which enables a laser light emitting diode (LED) to generate a stable laser light-spot while preventing the parts in the circuit from being damaged.

2. Description of the Related Art

In various situations such as a meeting, a symposium or a conference, etc., a speaker often uses an overhead projector, a projection screen and a plurality of overhead projector transparency sheets having an abstract and the summaries of the contents or graphics thereon to give a speech or report. If the projection screen is large, in order not to block a projecting light or to prevent the pictures on the projection screen to be uninteresting, the speaker uses a baton which is pointed to the corresponding texts and drawings on the projecting screen in conjunction with the contents of the speech or report.

Formerly, the baton which is most commonly seen is of a multisection telescopic structure which is pen-sized when contracted. When in use, the baton is extended and a front end of the extended baton is referred to as a guide. Such a structure cannot be used in a large-size projecting screen mostly due to a limitation in length and further the baton itself may block projecting light so that the projecting images will be interfered with.

On account of the development in electronics technology, among the new developing electronic products, a laser indicator substitutes for a conventional baton and solves these prior problems in use.

FIG. 2 shows an existing laser indicator 80 on the market. The configuration of the laser indicator 80 is like a pen on which a button 81 is installed. A laser light generated by a laser light emitting diode (LED) in the laser indicator 81 is focused to form a distinct red light-spot where the laser indicator 80 is pointed to and the related texts or drawings thereto are guided by the red light-spot.

The aforementioned laser indicator 80 has been increasingly popularized because of its compact size and ease of use together with an absence of shadow interference when in use.

Accordingly, the laser indicator 80 generates the laser light by using the laser LED and produces a laser light-spot on the screen at which the laser indicator 80 is pointed. Thus, the brightness and stability of the laser light-spot has a direct impact on an indicating performance of the aforesaid laser indicator 80. Therefore, how to make the laser LED in the laser indicator generate a stable laser light-spot is a main issue of the present invention.

SUMMARY OF THE INVENTION

The present invention is directed to a circuit for protecting a laser indicator.

An objective of the present invention is to provide a circuit for protecting a laser indicator, in which a laser light emitting diode (LED) in the laser indicator produces a stable laser light-spot while the components in the circuit will not be damaged.

In accordance with an aspect of the invention, there is provided a circuit for protecting a laser indicator, in which a current amplifying circuit is composed of a PNP type transistor and an NPN type transistor, an emitter of the PNP type transistor is coupled to a positive power source through a first protective resistor and a collector thereof is coupled to a base of the NPN type transistor, and a base of the PNP type transistor is coupled to a negative power source through a second protective resistor and a variable resistor; a collector of the NPN type transistor is coupled to the positive power source through a laser LED; whereby a design of such a circuit enables the brightness and light intensity of a laser light to be gradually stabilized due to a stable operating voltage achieved by the laser LED.

BRIEF DESCRIPTION OF THE DRAWINGS

The above objective, other features and advantages of the present invention will become more apparent by describing in detail the preferred embodiment thereof with reference to the attached drawings, in which.

DETAILED DESCRIPTION OF THE PREFERRED EMBODIMENT

Figure 1:
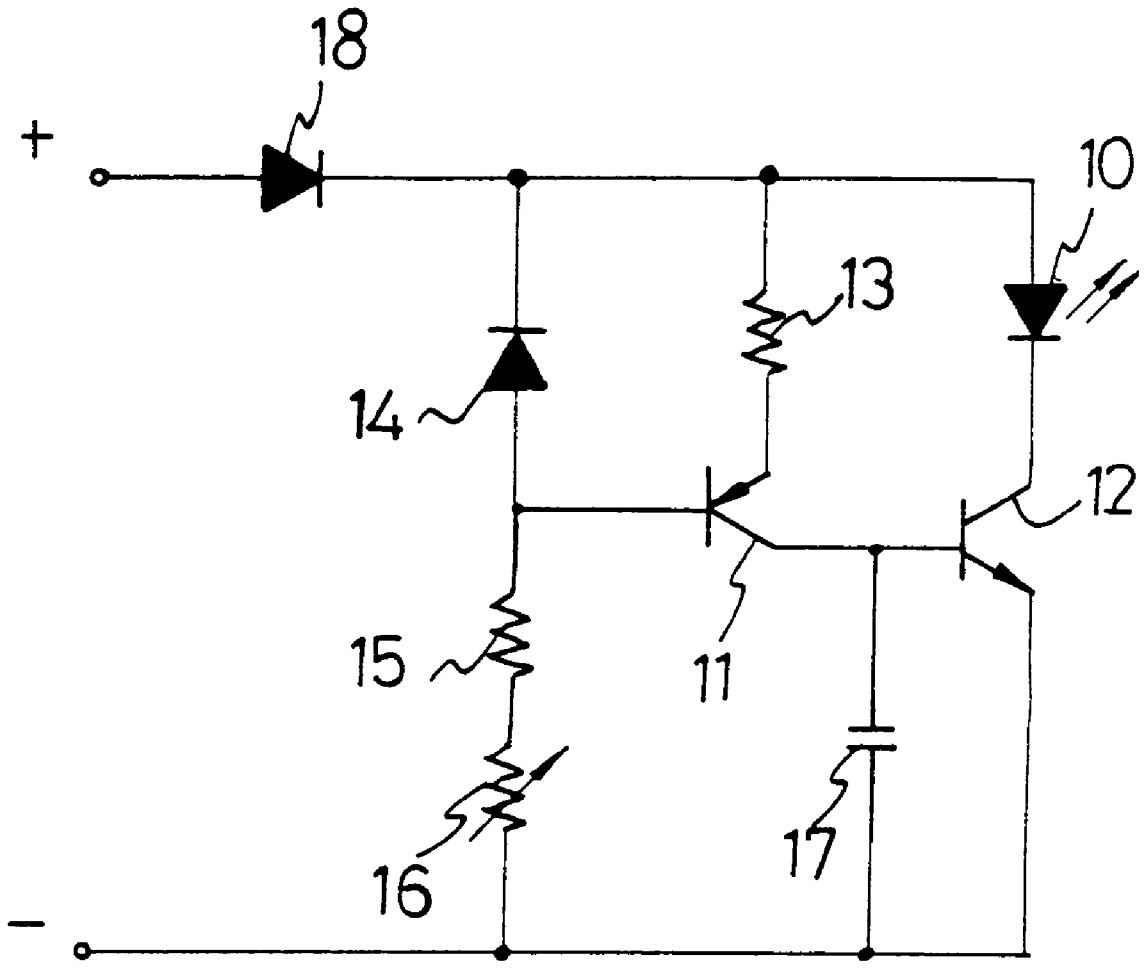
FIG. 1 shows a schematic illustration of a circuit for protecting a laser indicator in accordance with the present invention.
Figure 2:
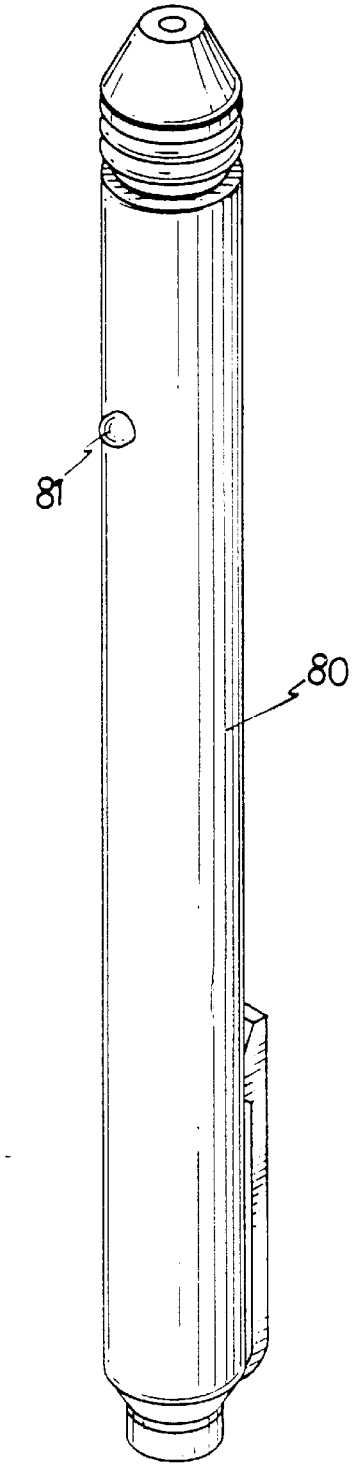
FIG. 2 PRIOR ART
FIG. 2 shows a conventional laser indicator.

FIG. 1 shows a schematic illustration of a circuit for protecting a laser indicator in accordance with the present invention, mainly including a current amplifying circuit which is composed of two transistors 11, 12 to drive a laser light emitting diode (LED) 10, in which one transistor 11 is of a PNP type and the other transistor 12 is of an NPN type. An emitter of the PNP transistor 11 is connected to a positive power source through a first protective resistor 13 and a collector thereof is connected to a base of the NPN transistor 12, and a base of the PNP transistor 11 is connected to the positive power source through a first diode 14 as well as being connected to a negative power source through a second protective resistor 15 and a variable resistor 16.

A collector of the NPN transistor 12 is connected to the positive power source through the laser LED 10. In addition to being connected to the collector of the PNP transistor 11, the base of the NPN transistor 12 is also connected to the positive power source through a capacitor 17 to prevent the power source from oscillating, while an emitter thereof is connected to the negative power source.

The current amplifying circuit composed of the aforementioned two transistors 11 and 12 is adapted to be further in connection with devices such as the aforenamed two protective resistors 13 and 15, the variable resistor 16 and the first diode 14 to constitute a circuit for protecting a laser indicator in accordance with the present invention. A second diode 18 is connected to a positive power input terminal of this protective circuit to prevent the components in this circuit from being damaged when the polarities of a direct current (DC) power source are reversely connected.

The operation of this protective circuit is described as follows.

When the protective circuit described above is connected to the DC power source, the electrical current drives the laser LED 10 to turn on after having been amplified by the current amplifying circuit which is composed of the two transistors 11 and 12. The current amplifying circuit keeps an operating voltage thereof stable through the two protective resistors respectively connected to the emitter and the base of the PNP transistor 11 and the variable resistor 16 so that the laser LED 10 achieves a stable voltage to make the light intensity of the laser light produced by the laser LED 10 gradually stable.

Furthermore, the operating voltage of the current amplifying circuit 10 can be varied by regulating the variable resistor 16 connecting with the base of the PNP transistor 11 because the greater the current flowing through the two transistors 11 and 12, the smaller the resistance of the variable resistor 16 will be. The PNP transistor 11, the NPN transistor 12 and the laser LED 10 could be possibly damaged due to an overrating current. Therefore, except that the variable resistor 16 is connected to the base of the PNP transistor 11 as described above, the other protective resistor 15 is also connected thereto to maintain a required operating current and further to protect the components in the protective circuit.

Also, the second diode 18 connected between the positive power input terminal of the protective circuit and the base of the PNP transistor 11 is used to prevent the components in the circuit from being damaged due to reversely connecting the polarities of the DC power source.

Accordingly, the present invention has at least the following advantages.

1. The present invention utilizes the current amplifying circuit incorporating with the related elements to produce a stable operating current and thereby providing a stable operating voltage to the laser LED so that the light intensity of the laser light generated by the laser LED is stabilized for promoting the indicating performance.

2. The above-described current amplifying circuit is further in conjunction with the protective resistor, the variable resistor and the diode connected to the base and the emitter of one of the two transistors such that the operating current of the protective circuit gradually becomes stable so that the components in the circuit are protected from damage and an effect of energy saving is achieved as well.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A circuit for protecting a laser indicator comprising a current amplifying circuit composed of a PNP type transistor and an NPN type transistor, wherein an emitter of the PNP type transistor is connected to a positive power source via a first protective resistor and a collector thereof is connected to a base of the NPN type transistor, and a base of the PNP type transistor is connected to a negative power source via a second protective resistor and a variable resistor;

a collector of the NPN type transistor is connected to the positive power source via a laser light emitting diode (LED);

whereby a design of such a circuit enables the light intensity and brightness of a laser light to be gradually stabilized due to a stable operating voltage achieved by the laser LED.

2. The circuit as claimed in claim 1, wherein a diode is connected to a positive power input terminal of said current amplifying circuit to prevent said circuit for protecting a laser indicator from being damaged due to being reversely connected the polarities of the power source.

3. The circuit as claimed in claim 2, wherein an additional diode is connected between said base of said PNP type transistor and said positive power input terminal of said current amplifying circuit.

4. The circuit as claimed in claim 1, wherein a capacitor is connected between said base of said NPN type transistor and said negative power source.

* * * * *